US005946722A

United States Patent [19]

Trautmann

[11] Patent Number: 5,946,722

[45] Date of Patent: Sep. 7, 1999

[54] PATIENT PRIVACY GOWN

[76] Inventor: Charlotte B. Trautmann, 418 Happy Trail, San Antonio, Tex. 78231

[21] Appl. No.: 08/864,468

[22] Filed: May 28, 1997

[51] Int. Cl.[6] ..... A41D 13/00

[52] U.S. Cl. ..... 2/83; 2/114; 2/69

[58] Field of Search ..... 2/69, 69.5, 75, 2/80, 83, 104–106, 113–115, 912–914, 88

[56] References Cited

U.S. PATENT DOCUMENTS

| | | | |
|---|---|---|---|
| D. 236,293 | 8/1975 | Banks . | |
| 2,556,931 | 6/1951 | Miller | 2/114 |
| 2,911,650 | 11/1959 | Gerich | 2/104 |
| 3,490,072 | 1/1970 | Keltner | 2/114 |
| 4,570,268 | 2/1986 | Freeman . | |
| 4,653,120 | 3/1987 | Leaf . | |
| 5,093,932 | 3/1992 | Doyle . | |
| 5,133,086 | 7/1992 | Truitt et al. . | |
| 5,157,789 | 10/1992 | Klass | 2/114 |
| 5,184,351 | 2/1993 | Benstock . | |
| 5,228,141 | 7/1993 | Remsky et al. . | |
| 5,361,414 | 11/1994 | Smith . | |
| 5,440,763 | 8/1995 | Shah et al. . | |
| 5,621,917 | 4/1997 | Howsden . | |

*Primary Examiner*—Gloria Hale
*Attorney, Agent, or Firm*—Miller, Sisson, Chapman & Nash, P.C.

[57] ABSTRACT

The patient privacy gown, more particularly a patient privacy gown wherein the front has a slit opening beginning below the neckline and terminating above the hemline. The slit opening allows the patient to maintain modesty while allowing the doctor access to the patient's torso.

8 Claims, 2 Drawing Sheets

PATIENT PRIVACY GOWN

FIELD OF THE INVENTION

A patient privacy gown, more specifically a patient privacy gown comprising a one-piece garment having a slit opening centrally located on the front, the opening beginning beneath the neckline and terminating above the lower hemline.

BACKGROUND OF THE INVENTION

Patients in hospitals, clinics, or doctors' offices are often provided with a privacy gown in an effort to help patients maintain their modesty during examinations. Numerous prior art hospital gowns have been designed in an effort to achieve a maximum amount of patient privacy while allowing the health care professional access to the patient's body for performing the various tests and examination procedures.

For example, a popular cloth examination gown is one made of a single sheet of dacron/cotton blend material with two ties behind the neck and two rear vertical hems. While the rear section is split in two and tied together at the back of the neck, the front section is solid. This may be acceptable for some types of examinations. However, it compromises the patient's modesty for other types of examination, for example, breast or vaginal examinations by an OB/GYN health care specialist. These and some general examinations, such as a total general physical or abdominal organs examination, may be performed with more modesty to the patient than presently allowed by such gowns while also providing access to the patient's body. Modesty concerns make desirable a maximum amount of access with a minimum amount of actual exposure of the body.

Prior art hospital gowns have attempted to achieve modesty while providing access to the patient's body. For example, U.S. Pat. No. 5,440,763 (Shah) discloses a multipurpose patient gown with a front capable of being open from the neckline down to the hemline and further capable of being unfastened, in sections, so as to expose limited portions of the patient's body, such as the breast. Another approach taken to the problem of providing an examination gown that maintains modesty while allowing the health care professional access to the patient's body is found in U.S. Pat. No. 5,093,932 (Doyle). This patent discloses an examination garment with a frontal access opening beginning at the neckline and running down the front of the torso. The Doyle reference also includes an opening in the upper leg area of the pants, adjacent the crotch, to allow access to the groin area while the rest of the patient remains covered.

These are only two examples of the many prior art hospital gowns which have been designed in an effort to maintain modesty while providing access to the patient's body for proper examinations.

None of the prior art hospital gowns have achieved maximum simplicity while providing in a one-piece gown full access to critical areas of most general exams and specifically for many of the typical OB/GYN examinations, such as breast exams, fundal measurements, heart tones, and bi/manual vaginal examinations.

OBJECTS OF THE INVENTION

It is, therefore, the object of Applicant's present invention to provide in a simple, easy to manufacture, one-piece patient hospital gown, the dual aims of access to the patient's body and maintenance of patient modesty.

SUMMARY OF THE INVENTION

Applicant provides a one-piece garment having a rear opening and tieing at the neck, with a front panel having a vertical slit, the vertical slit opening beginning below the neckline and terminating above the hemline, which vertical slit provides access to the patient's torso and groin area while maintaining maximum privacy for the patient. The slit opening may be provided with a closure means to keep the two opposing walls of the slit together.

DETAILED DESCRIPTION OF THE PREFERRED EMBODIMENT

Figure 1:
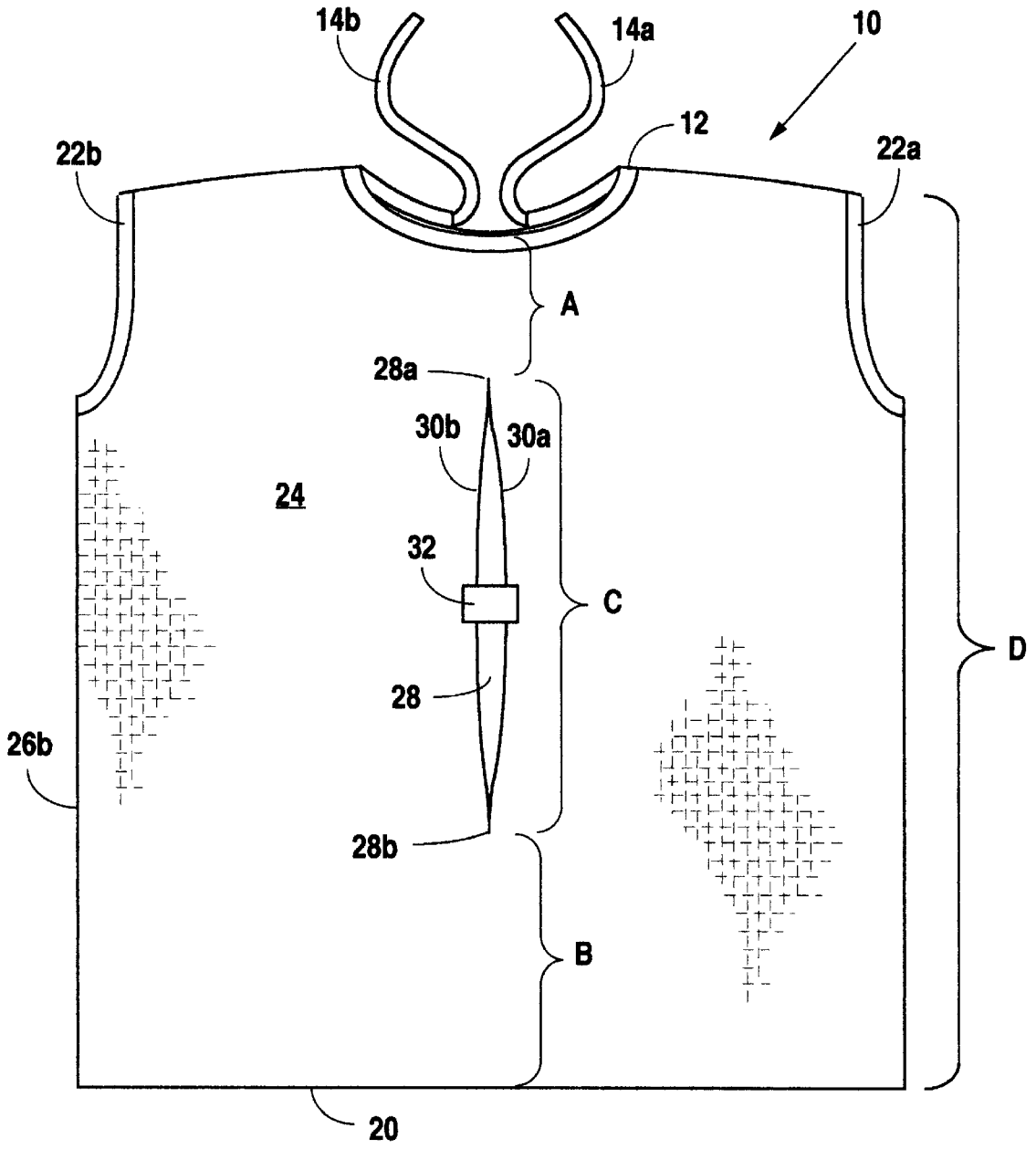
FIG. 1 is a front elevational view of the gown of Applicant's present invention.
Figure 2:
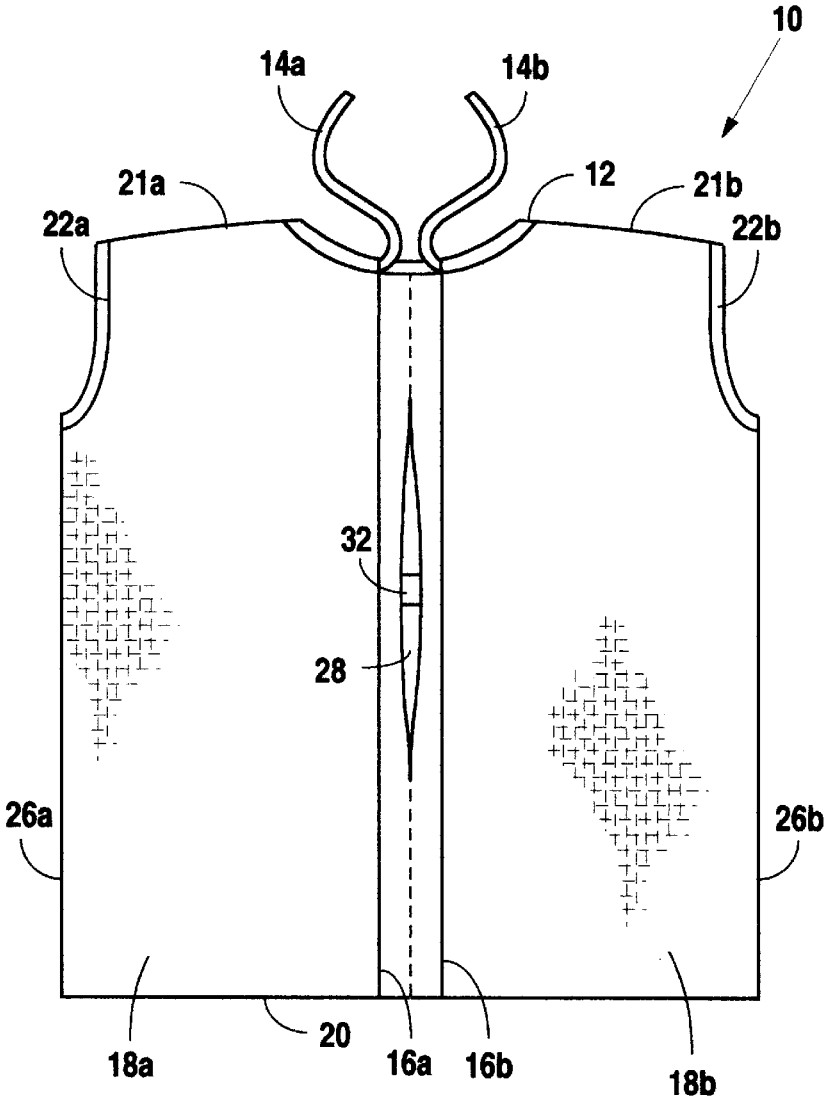
FIG. 2 is a rear elevational view of the gown of Applicant's present invention.
Figure 3:
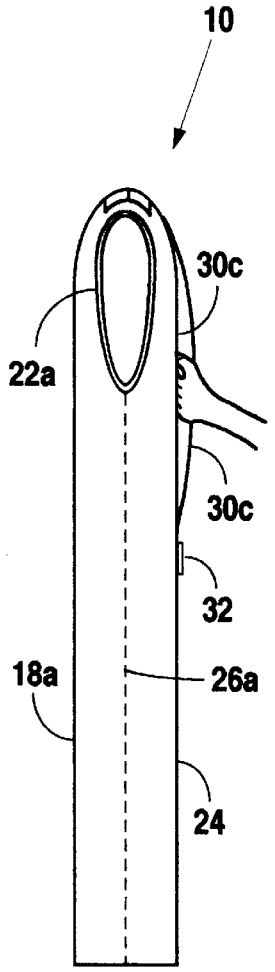
FIG. 3 is a side elevational view of the gown of Applicant's present invention showing how the slit opening will provide access to the patient's body for examination purposes.

FIGS. 1–3 illustrate Applicant's patient privacy gown, seen here to comprise a garment (10) typically one piece and made of a fabric such as paper, cotton, cotton blend, or other cloth. The garment includes a neckline (12) having a pair of rear ties **(14*a*) and (14*b*)** which are secured in a conventional manner, such as by knotting them at the rear of the patient's neck to maintain the gown on the patient's body. In the alternative, Velcro® closure means may be used but, with patient having longer hair, tangling may result.

It is seen with reference to FIG. 2 that there are a pair of rear vertical hems **(16*a*) and (16*b*) running form the neckline (12) vertically downward and defining a pair of rear sections (18*a*) and (18*b*), typically each between 12" and 24" wide, optionally 16" wide. The rear vertical hems terminate at a lower hemline (20)**.

The gown includes shoulder seams **(21*a*) and (21*b*) above arm holes (22*a*) and (22*b*), which typically have arm hole facings thereon. The shoulder seams define the boundary between rear sections (18*a*) and (18*b*) and a front section (24). Below arm holes (22*a*) and (22*b*) are side seams (26*a*) and (26*b*) which descend vertically to join the lower hemline. As seen in FIG. 1, the garment (10) has a solid front with, typically, a front center seam (27) beginning at the neckline (12) and terminating at the lower hemline (20)**.

Garment (10) includes a slit opening (28) for providing access to the body of the patient. Slit opening (28) has an upper end **(28*a*) and a lower end (28*b*), and is defined by a pair of opposing walls (30*a*) and (30*b*), each of the walls beginning at upper end (28*a*) and terminating at lower end (28*b*). The slit may be maintained in a closed position through the use of a closure tab (32), such as a pair of hook and loop or VELCRO™ pads, one each joined opposite one another to the opposing walls (30*a*) and (30*b*) of the slit opening (28)**. The gown could have more closure tabs or none at all, but one is preferred.

Thus, it is seen that the solid front of garment (10) can maintain the patient's privacy while allowing the healthcare professional access to the upper and lower torso area (see FIG. 3) where a hand can be slipped through the slit or the slit could be opened for access to, for example, the breast area, or near the lower end of the slit opening for access to, for example, the groin or pelvic region. Further, it is seen that the tab can remain closed during the examination; or, if more room is needed, the tab can be opened. In either fashion, however, the use of the slit opening for access provides a maximum amount of privacy, helping to ensure the patient's modesty while still allowing sufficient access for the healthcare professional to perform examinations.

It is noted that upper end (28*a*) begins below the neckline at a distance designated (A) in FIG. 1. It is further seen, with reference to FIG. 1, that lower end (28*b*) of slit opening (28) terminates above lower hemline (20) a distance designated (B) in FIG. 1. The distance between the upper end and the lower end of slit opening (28) (the length of the opening) is designated (C) in FIG. 1. Last, the length of the gown, between the shoulder seams and the lower hemline is designated (D) in FIG. 1.

Applicant has determined that the following dimensions are suitable: (A)=3" to 6" (4½" optimal); (B)=8" to 12" (10" optimal); (C)=16" to 24" (20" optimal); and (D)=3' to 4' (3'6" optimal). The more important measurements for good access to the patient and yet retention of modesty are the dimensions (A) and (C) above. Many other dimensions may also function well; and it is anticipated that, for different sized patients or different types of examinations, other dimensions may be suitable as well.

Typically, center hemline (34) is created by sewing two panels of material (36*a* and 36*b*) to create the front section. Typically, each of these panels are 12" to 24" wide, optionally 16". Last, it is noted from FIG. 1 that the neckline is cut lower in the front, typically 1" lower than the neckline at the back, where the ties are used.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. A hospital gown comprising:

a flexible fabric body member having a front portion, a vertically split rear portion divided into two segments, a neck opening, a lower hemline, and sleeve openings for the arms to extend therethrough;

ties for retaining the two segments of the vertically split rear portion together; and opposing walls defining a centrally located vertical slit in the front portion, the vertical slit beginning below the neckline and terminating above the hemline and wherein the slit begins below the neckline a distance of between about 3" and about 6", and wherein the slit terminates above the hemline a distance of between about 8" and about 12".

2. The hospital gown of claim 1 further comprising:

a closure tab, engaging said opposing walls, for removably securing the slit in a closed position, the open position allowing access to the torso of the patient, the closed position for properly covering the patient to maintain personal modesty.

3. The hospital gown of claim 2, wherein the closure tab is comprised of a pair of hook and pile pads, attached to opposing walls of the vertical slit.

4. The hospital gown of claim 3, wherein the length of the slit opening is between 16" and 24".

5. The hospital gown of claim 1, wherein the length of the gown is between 3' and 4'.

6. The hospital gown of claim 1, wherein the garment is comprised of either cloth or paper.

7. The hospital gown of claim 2, wherein the garment is comprised of either cloth or paper.

8. The hospital gown of claim 3 wherein the garment is comprised of either cloth or paper.

* * * * *